US011484058B2

(12) United States Patent
Grochowski et al.

(10) Patent No.: US 11,484,058 B2
(45) Date of Patent: Nov. 1, 2022

(54) CIGARETTE TUBE OR CONE FILLING DEVICE

(71) Applicant: Grouch Designz, LLC, Willowbrook, IL (US)

(72) Inventors: James Anthony Grochowski, Willow Springs, IL (US); Joshua Douglas Cole, Sterling Heights, MI (US)

(73) Assignee: Grouch Designz, LLC, Oxford, MI (US)

( * ) Notice: Subject to any disclaimer, the term of this patent is extended or adjusted under 35 U.S.C. 154(b) by 251 days.

(21) Appl. No.: 16/812,092

(22) Filed: Mar. 6, 2020

(65) Prior Publication Data

US 2020/0281252 A1 Sep. 10, 2020

Related U.S. Application Data

(60) Provisional application No. 62/815,518, filed on Mar. 8, 2019.

(51) Int. Cl.
*A24C 5/42* (2006.01)
*A24C 5/02* (2006.01)

(52) U.S. Cl.
CPC . *A24C 5/42* (2013.01); *A24C 5/02* (2013.01)

(58) Field of Classification Search
None
See application file for complete search history.

(56) References Cited

U.S. PATENT DOCUMENTS

| | | | | |
|---|---|---|---|---|
| 956,701 | A | 5/1910 | Goss | |
| 1,371,135 | A | 3/1921 | Williams | |
| 2,100,397 | A | 11/1937 | Hollander | |
| 2,594,747 | A | 2/1952 | Laney | |
| 2,625,937 | A | 1/1953 | Sperry | |
| 3,509,887 | A | 5/1970 | O.Kappeler et al. | |
| 3,741,220 | A | 6/1973 | Meinunger | |
| 5,009,237 | A | 4/1991 | Schmidt et al. | |
| 8,607,801 | B1 | 12/2013 | Mardirosoglu et al. | |
| 10,485,262 | B1 * | 11/2019 | Whitmer | A24C 5/39 |
| 2015/0223519 | A1 | 8/2015 | Bao | |

* cited by examiner

*Primary Examiner* — Phu H Nguyen
(74) *Attorney, Agent, or Firm* — Erickson Law Group, PC

(57) ABSTRACT

A cigarette tube or cone filling device includes a tray for holding a supply of, tobacco, smokable herbs or other material, with an outlet opening, and a cartridge for holding a cigarette tube or cone in a vertical orientation with the cigarette having an open end beneath the outlet opening. A cap can be fit over the cartridge and above the open end of the cigarette tube or cone with a nozzle for fitting into the open end to hold the open end open during filling. The tray has a slide retainer that receives horizontal top flanges or plates of the cartridge and the cap to hold both cartridge and cap tightly together and tightly to the tray, with the nozzle in registry with the outlet opening.

12 Claims, 5 Drawing Sheets

FIG. 3
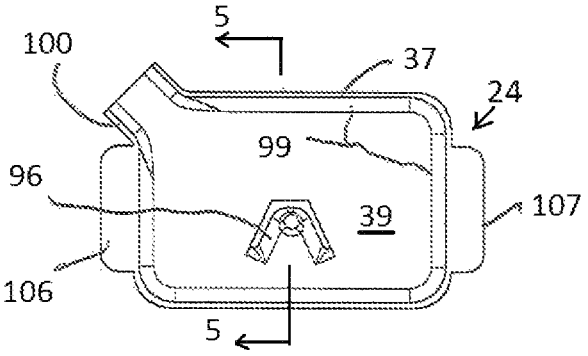
FIG. 5
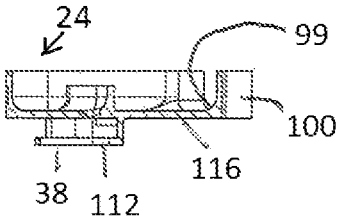
FIG. 4
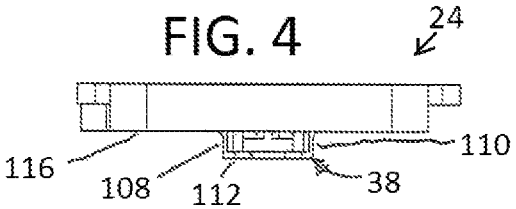
FIG. 6
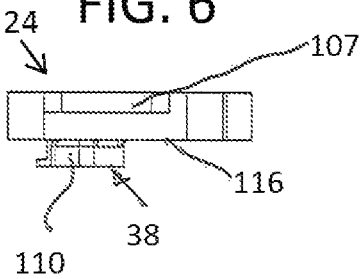
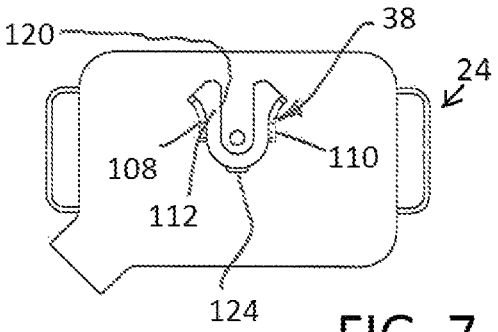
FIG. 7

CIGARETTE TUBE OR CONE FILLING DEVICE

This application claims the benefit of U.S. Provisional Application 62/815,518, filed Mar. 8, 2019.

BACKGROUND

The invention relates to a mechanism for filling preformed paper cigarette tubes or cones with tobacco, smokable herbs or other smokable material.

Some veterans who have been injured physically have difficulty rolling cigarettes.

There have been prior attempts to provide a mechanism for filling cigarette tubes or cones with tobacco. For example, U.S. Pat. Nos. 3,741,220; 3,509,887; 8,607,801; 1,371,135; 2,100,397; 2,594,747; and 5,009,237 disclose mechanisms for filling cigarette tubes. These patents are all herein incorporated by reference to the extent that they are not contrary to the present disclosure.

The present inventor has recognized that it would be desirable to provide a mechanism for filling cigarette tubes or cones with tobacco or other smokable material that was an improvement over prior art devices. The present inventor has recognized that it would be desirable to provide a mechanism for filling cigarette tubes or cones with tobacco or other smokable material that is handheld, reliable, effective and easy to use. The present inventor has recognized that it would be desirable to provide a mechanism for filling cigarette tubes or cones that can be operated by users with limited dexterity.

SUMMARY

The exemplary embodiment of the present invention provides a cigarette tube or cone filling device that includes a tray for holding a supply of tobacco, smokable herbs or other smokable material, with an outlet opening, and a cartridge for holding a cigarette tube or cone in a vertical orientation with the cigarette having an open end beneath the outlet opening. A cap can be fit over the cartridge and above the open end of the cigarette tube or cone with a nozzle for fitting into the open end to hold the open end open during filling. The tray has a slide retainer that receives horizontal top flanges or plates of the cartridge and the cap to hold both cartridge and cap tightly together and tightly to the tray, with the nozzle in registry with the outlet opening.

The cartridge includes a downward vertical tab formed contiguously with the top flange of the cartridge and the tab has a central vertical slot. The cap comprises a plate and a downward vertical tab formed contiguously with the plate. A rib is formed on the tab beneath the plate. The rib is located and sized to resiliently snap into the slot of the cartridge tab. This locates the cap correctly onto the cartridge.

Facing surfaces of the cap plate and the cartridge flange have engaging formations to hold the cap to the cartridge and properly locates the cap to the cartridge. The cartridge includes a cylinder or elongated cone with a bottom wall and an open top end through the cartridge flange. The cylinder or elongated cone extends vertically downward from an under surface of the cartridge flange.

The tray includes a U-shaped or V-shaped wall within the tray and around the outlet opening and beveled inside corners to help deliver smokable material toward the outlet port. The tray also includes a short trough for removing remaining smokable material in an orderly manner without undue spillage. The tray can also include opposing handles for ease of handling.

In use, an empty cigarette tube or cone is placed though the flange and into the cylinder or elongated cone of the cartridge. The cylinder or elongated cone is sized to hold the empty cigarette tube or cone open end near to the top of the cylinder or elongated cone. Once the empty cigarette tube or cone is placed into the cylinder or elongated cone, the cap is snapped onto the cartridge and the nozzle fits into the top of the empty cigarette tube or cone. The rib of the cap fits tightly into the slot of the cartridge tab. The assembly of the cap and the cartridge is then fit under the delivery tray and the cap plate and the cartridge flange are slid into the slide retainer. Once the assembly is fully fit into the slide retainer, the delivery port is in registry with the nozzle in the cap and the open end of the cigarette tube or cone in the cartridge. Smokable material can then be moved within the tray by an implement, finger or by shaking the tray and into the outlet opening, down through the nozzle and into the cigarette tube or cone. Once the tube or cone is filled, the assembly can be slid out of the slide retainer, and separated from the tray. The cap can be snapped off of the cartridge and the finished filled cigarette tube or cone removed.

The device is easy to use and reduces spillage.

Different cartridges can be provided with different cylinder or elongated cone lengths to fill shorter or longer cigarette tubes or cones. The cap can be universal for all the different cartridges. Alternately, the different cartridges can have different cylinder or elongated cone lengths and/or diameters to fill varying longer and/or wider cigarette tubes or cones. The cap can be universal or varying to match the nozzle with the diameter of the cylinder or elongated cone.

The exemplary embodiment device loads tobacco or other smokable material into a pre rolled cigarette or pre rolled cigarette cone faster and easier than traditional methods. It utilizes a cartridge to secure a pre rolled cigarette or pre rolled cigarette cone underneath a material tray. The user pushes the tobacco or other smokable material through a loading hole and into the pre rolled cigarette or pre rolled cigarette cone.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 3 is a plan view of a tray of the device of FIG. 1;

FIG. 4 is a front view of the tray of the device of FIG. 3;

FIG. 5 is a sectional view of the tray taken generally along line 5-5 of FIG. 3;

FIG. 6 is a side view of the tray of the device of FIG. 3;

FIG. 7 is a bottom view of the tray of the device of FIG. 3;

DETAILED DESCRIPTION

Figure 1:
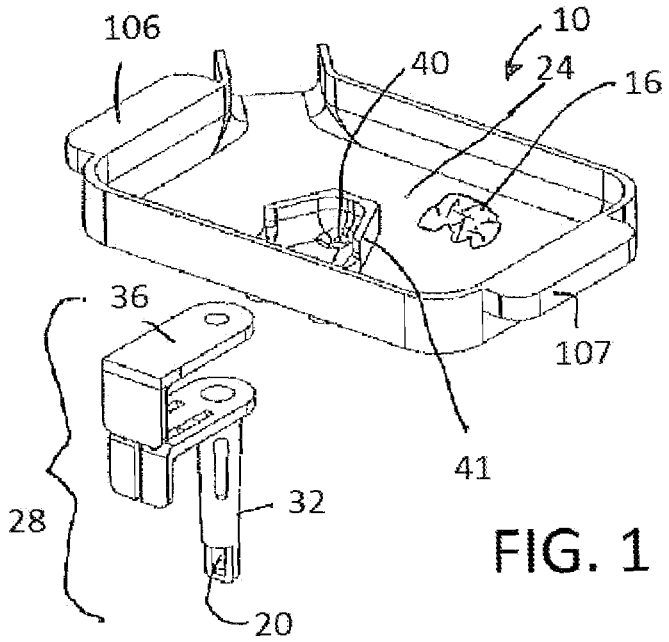
FIG. 1 is an exploded perspective view of an exemplary embodiment of a cigarette filling device according to the invention in an unassembled configuration.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporated by reference U.S. Provisional Application 62/815,518, filed Mar. 8, 2019.

FIG. 1 shows a cigarette filling device 10 holding smokable material such as tobacco or other smokable material 16 to be filled into a preformed cigarette tube or cone 20.

The device includes a tray 24 engagable to an assembly 28 comprising a cartridge 32 and a cap 36, shown separated. The tray 24 includes a surrounding sidewall 37, a bottom wall 39, and a slide retainer 38 (FIGS. 3-7) on a bottom side thereof and an outlet opening 40. The tray includes a U-shaped or V-shaped wall 41 for assisting in directing the smokable material into the outlet opening 40.

Figure 8:
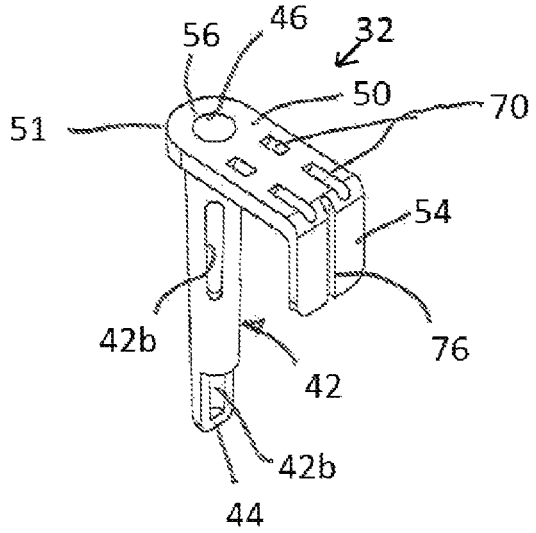
FIG. 8 is a perspective view of a cartridge of the device in FIG. 1.
Figure 9:
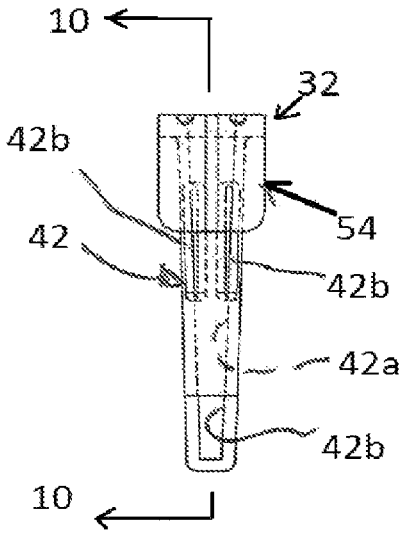
FIG. 9 is a front view of the cartridge shown in FIG. 8.
Figure 10:
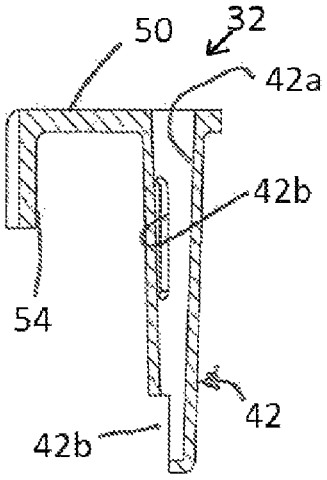
FIG. 10 is a sectional view taken generally along line 10-10 of FIG. 9.

The cartridge 32 is shown in FIGS. 8-10. The cartridge 32 includes a cylinder or elongated cone 42 having a bottom wall 44 and an open top end 46. The cartridge 32 includes a flange 50, wider than the cylinder or elongated cone 42, with a rounded end 51 and a downward turned cartridge tab 54. The flange has an opening 56 that is in registry with the open top end of the cylinder or elongated cone. The cylinder or elongated cone 42 includes a tapered channel 42*a* for ease in loading cigarette tubes or cones and windows 42*b* for viewing the cigarette tube or cone 20 within the cylinder or elongated cone 42.

Figure 11:
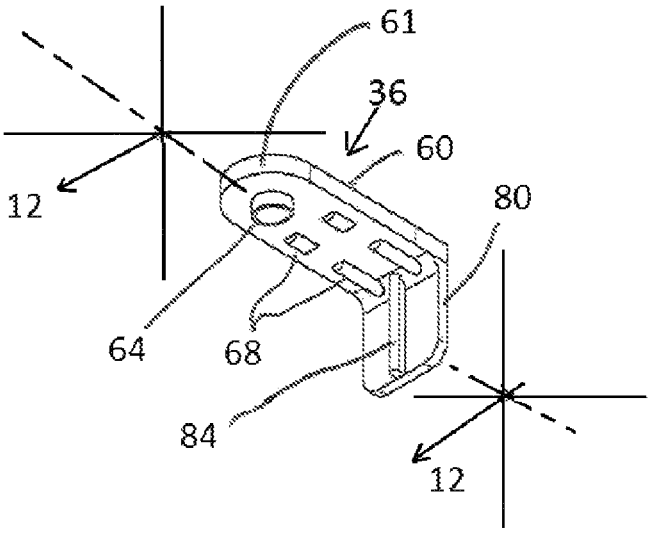
FIG. 11 is a bottom perspective view of a cap taken from FIG. 1.
Figure 12:
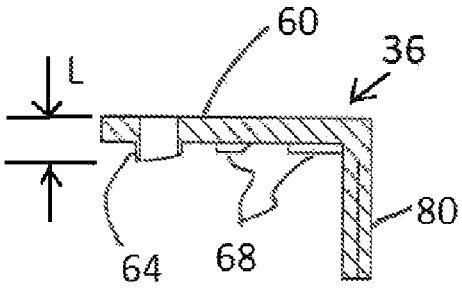
FIG. 12 is a sectional view taken generally along line 12-12 of FIG. 11.

The cap 36 is shown in FIGS. 11 and 12. The cap 36 includes a plate 60, wider than the cylinder or elongated cone 42, having a rounded end 61 and a nozzle 64 that, when the cap is installed onto the cartridge, is in registry with the flange opening 56, and the nozzle has a length L that extends down through and past the flange 60, into the cylinder or elongated cone 42 and inside the open top end of the cigarette tube or cone. The plate 60 includes tabs 68 that face the cartridge flange which has recesses 70 corresponding in location and size to the tabs. When the plate 60 is fit onto the flange 50, the tabs 68 fit into the recesses 70 to precisely locate the plate to the flange.

The downward turned cartridge tab 54 of the cartridge has a central vertical slot 76. The cap includes a downward vertical tab 80 formed contiguously with the plate. A rib 84 is formed on the tab 80 beneath the plate 60. The rib 84 is located to resiliently snap into the slot 76 of the cartridge tab 54. This locates the cap correctly onto the cartridge.

The tray 24 is shown in FIGS. 3-7. The wall 41 around the outlet opening 40 has radiused or inclined inside corners 96 between the wall 41 and the tray bottom wall 39 to help deliver smokable material toward the outlet opening 40. The tray has radiused or inclined inside corners 99 all around between the sidewall 37 and the bottom wall 39 to assist in delivering smokable material toward the outlet opening 40. The tray also includes a short trough 100 for removing remaining smokable material in an orderly manner without undue spillage. The tray 24 also includes side handles 106, 107 for manipulating the tray by a user.

The slide retainer 38 of the tray 24 comprises sidewalls 108, 110 supporting a bottom wall 112 spaced from a bottom 116 of the tray bottom wall 39. The bottom wall 112 is somewhat U-shaped and includes a slot 120 wide enough to accommodate the cylinder or elongated cone 42 of the cartridge during engagement of the cartridge with the retainer 38, but narrow enough to not vertically pass the flange 50 and the plate 60. The sidewalls 108, 110 are curved defining a tapered path toward the opening 40, to guide the plate 60 and flange 50 of the assembly 28 into proper alignment with the outlet opening 40. The curved ends 51, 61 also interact with the sidewalls 108, 110 to guide engagement of the assembly 28 to the retainer 38. An end wall 124 also stops the insertion of the plate 60 and flange 50 at the proper location. In the proper location, the plate 60 and flange 50 are together captured vertically between the bottom wall 112 and the bottom 116 of the tray bottom wall 39, and the cylinder or elongated cone 42 of the cartridge fits into the slot 120. The proper location of the assembly 28 is when the bottom opening 40 is aligned with the nozzle 56 and openings 46, 56.

Figure 2:
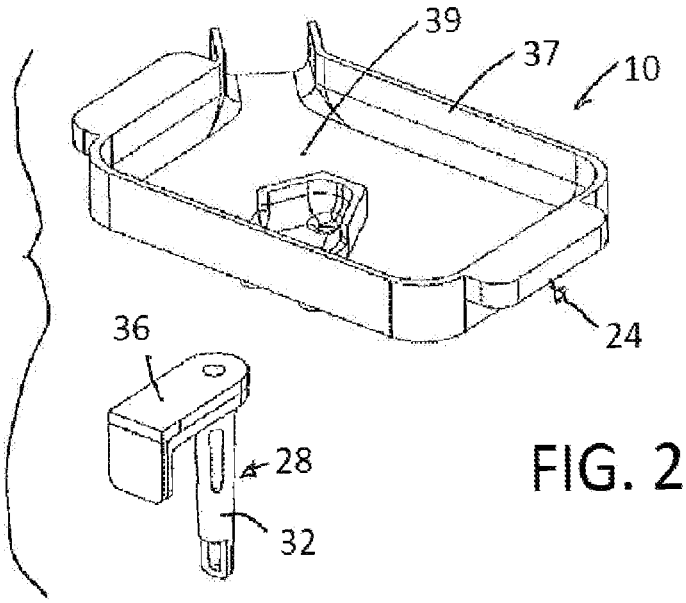
FIG. 2 is perspective view of the device of FIG. 1, in a first stage of assembly.
Figure 13:
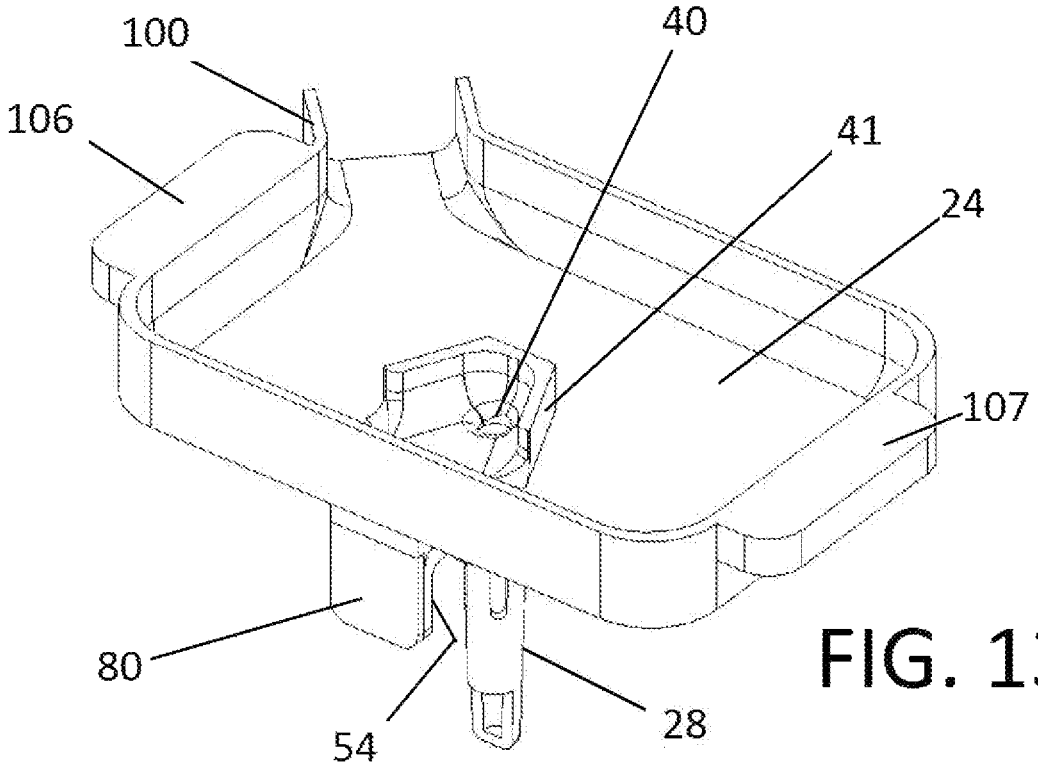
FIG. 13 is a perspective view of the device, fully assembled in operating condition.

In use, an empty cigarette is placed though the flange opening 56 and into the cylinder or elongated cone. The cylinder or elongated cone is sized to hold the empty cigarette tube or cone open end near to the top of the cylinder or elongated cone. Once the empty cigarette tube or cone is placed into the cylinder or elongated cone, the cap is snapped onto the cartridge (FIG. 2) and the nozzle fits into the top of the empty cigarette tube or cone as shown in FIG. 2. The rib of the cap tab fits tightly into the slot of the cartridge tab. The assembly 28 of the cap and the cartridge is then fit under the delivery tray and slid into the slide retainer (FIG. 13).

Once the assembly is fully fit into the slide retainer, the outlet opening is in registry with the nozzle in the cap and the open end of the cigarette tube or cone in the cartridge. Smokable material can then be moved within the tray by an implement, finger or by shaking the tray and into the outlet opening, down through the nozzle and into the cigarette tube or cone. Once the tube or cone is filled the assembly can be slid out of the slide retainer, and separated from the tray. The cap can be snapped off of the cartridge and the finished filled cigarette tube or cone removed from the cartridge.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A cigarette tube or cone filling device comprising:

a tray for receiving smokable material, the tray including an outlet port and a retainer;

a cartridge having a receptacle for receiving a cigarette tube or cone and holding the tube or cone vertically with an open end of the tube or cone up; and the cartridge held to the tray with the outlet port in registry with the open end of the cigarette tube or cone;

wherein a cap is configured to removably cover an opening of the cartridge to insert and remove a cigarette tube or cone;

wherein the cap covers a top opening of the cartridge and includes a nozzle that fits into the open end of the cigarette tube or cone; and wherein the cartridge includes a top flange and the cap includes a top plate, and the retainer is a slide retainer, and both the top flange and the top plate are retained by sliding into the slide retainer.

2. The device according to claim 1, wherein the cap includes a tab extending down from the top plate and the cartridge includes a tab extending down from the top flange, the cap tab closely overlying the cartridge tab, the cap tab and the cartridge tab having co-acting formations to removably snap the cartridge tab and the cap tab together.

3. The device according to claim 1, wherein the cap includes a tab extending down from the top plate and providing a handle for disengaging the cartridge from the tray.

4. The device according to claim 1, wherein the cartridge includes a tab extending down from the cartridge flange and providing a handle for disengaging the cartridge from the tray.

5. The device according to claim 1 wherein the container includes am outlet trough for emptying the tray.

6. A cigarette tube or cone filling device comprising:

a tray for receiving smokable material, the tray including an outlet port and a retainer;

a cartridge having a receptacle for receiving a cigarette tube or cone and holding the tube or cone vertically with an open end of the tube or cone up;

the cartridge held to the tray with the outlet port in registry with the open end of the cigarette tube or cone;

wherein a cap is configured to removably cover an opening of the cartridge to insert and remove a cigarette tube or cone;

wherein the cap covers a top opening of the cartridge and includes a nozzle that fits into the open end of the cigarette tube or cone;

wherein the cartridge includes a top flange and the cap includes a top plate, and the retainer is a slide retainer, and both the top flange and the top plate are retained by sliding into the slide retainer;

wherein at least one of the cap and the cartridge includes a handle for disengaging the cartridge from the tray for unloading a filled cigarette tube or cone from the cartridge and reloading an empty cigarette tube or cone into the cartridge.

7. The device according to claim 6, wherein the cap includes a tab extending down from the top plate and the cartridge includes a tab extending down from the top flange, the cap tab closely overlying the cartridge tab, at least one of the cap tab and the cartridge tab forming the handle.

8. A cigarette tube or cone filling device comprising:

an open top tray for receiving smokable material, the tray including an outlet port and a retainer;

a cartridge having a receptacle for receiving a cigarette tube or cone and holding the tube or cone vertically with an open end up;

a cap configured to cover the top of the cartridge and having a nozzle that fits into the open end of the cigarette tube or cone;

the cap and cartridge held to the tray with the outlet port in registry with the open end of the cigarette tube or cone; and wherein the cartridge includes a top flange and the cap includes a top plate, and the retainer is a slide retainer, and both the top flange and the top plate are retained by sliding into the slide retainer.

9. The device according to claim 8, wherein the cap includes a cap tab extending down from the top plate and the cartridge includes a cartridge tab extending down from the top flange, the cap tab closely overlying the cartridge tab, the cap tab and the cartridge tab having co-acting formations to removably snap the cap tab and the cartridge tab together.

10. The device according to claim 8, wherein the cap includes a cap tab extending down from the top plate and providing a handle for disengaging the cartridge from the tray.

11. The device according to claim 8, wherein the cartridge includes a cartridge tab extending down from the top flange and providing a handle for disengaging the cartridge from the tray.

12. The device according to claim 8, wherein the tray includes am outlet trough for emptying the tray.

* * * * *